US010976056B2

(12) United States Patent
Tiefnig et al.

(10) Patent No.: US 10,976,056 B2
(45) Date of Patent: Apr. 13, 2021

(54) GUIDE DEVICE FOR GUIDING A GOODS CARRIER

(71) Applicant: Grass GmbH, Hochst (AT)

(72) Inventors: Roland Tiefnig, Gaimberg (AT); Simon Mair, Lienz (AT)

(73) Assignee: GRASS GMBH, Hochst (AT)

( * ) Notice: Subject to any disclaimer, the term of this patent is extended or adjusted under 35 U.S.C. 154(b) by 89 days.

(21) Appl. No.: 16/217,782

(22) Filed: Dec. 12, 2018

(65) Prior Publication Data

US 2019/0186757 A1 Jun. 20, 2019

(30) Foreign Application Priority Data

Dec. 14, 2017 (DE) ..... 202017006449.9

(51) Int. Cl.
*F24C 15/16* (2006.01)

(52) U.S. Cl.
CPC ..... *F24C 15/168* (2013.01); *F24C 15/16* (2013.01)

(58) Field of Classification Search
CPC ..... F24C 15/16
USPC ..... 126/337 A, 337 R
See application file for complete search history.

(56) References Cited

U.S. PATENT DOCUMENTS 1,936,124 A * 11/1933 Wilson ..... A47J 37/04 312/274
2,069,706 A * 2/1937 Gerwig ..... F24C 15/162 126/340
3,059,634 A * 10/1962 Brinkman ..... F24C 15/16 126/337 R

FOREIGN PATENT DOCUMENTS

| | | | |
|---|---|---|---|
| DE | 102009000305 | | 7/2010 |
| EP | 1 258 686 | A1 | 11/2002 |
| EP | 3 181 012 | A1 | 6/2017 |
| EP | 3 358 258 | A1 | 8/2018 |
| JP | 2005030717 | | 2/2005 |
| WO | 2014082828 | A1 | 6/2014 |

* cited by examiner

*Primary Examiner* — Avinash A Savani
(74) *Attorney, Agent, or Firm* — Hoffmann & Baron, LLP

(57) ABSTRACT

A guide device for guiding a goods carrier within a housing has at least two guide units which are each, at a transverse distance from one another, on the one hand fixed to the housing and on the other hand coupled to the goods carrier, and which guide the goods carrier through a traversing movement between a slid-in operating position and a pulled-out position in which it is at least partially drawn out of the housing, a synchronisation device is provided in order to synchronise the movement of the guide units during the traversing movement of the goods carrier coupled to the guide units.

9 Claims, 7 Drawing Sheets

GUIDE DEVICE FOR GUIDING A GOODS CARRIER

BACKGROUND OF THE INVENTION

The invention relates to a guide device for guiding a goods carrier within a housing, having at least two guide units which are each, at a transverse distance from one another, on the one hand fixed to the housing and on the other hand coupled to the goods carrier, and which guide the goods carrier through a traversing movement between a slid-in operating position and a pulled-out position in which it is at least partially drawn out of the housing.

The use of guide devices for guiding a goods carrier within a housing of a heating device, for example a baking oven, is known from prior art which is not available in published form. In a quite conventional manner, guide rails are provided on opposite side walls of the housing of a baking oven which serve to support a goods carrier, for example in the form of a baking tray or oven rack. In order to remove the goods carrier from the housing it is necessary to grasp this by a front edge and pull it out of the housing. Guide devices are also known which are on the one hand fixed to the housing and on the other hand coupled to the goods carrier and which guide the goods carrier through a traversing movement between the operating position and the pulled-out position. However, in the case of both the conventional guide rails and also the guide device with the two guide units, it can occur that the goods carrier becomes misaligned or becomes canted against the side walls on being pulled out.

SUMMARY OF THE INVENTION

The object of the invention is therefore to create a guide device of the aforementioned type by means of which the at least one goods carrier guided thereon is reliably and safely guided between an operating position and a withdrawn pulled-out position.

This object is achieved by means of a guide device with the features of the independent claim 1. Further developments of the invention are presented in the dependent claims.

The guide device according to the invention is characterised in that a synchronisation device is provided in order to synchronise the movement of the guide units during the traversing movement of the goods carrier coupled to the guide units. The synchronisation unit thus ensures that the guide units are synchronised when the goods carrier is pulled out, preventing the goods carrier from becoming misaligned or canted against the side walls of the housing.

In a further development of the invention, the guide units are fastened to a rear wall of the housing by means of fastening means. Expediently, a fastening is provided in the central region of the rear wall in both directions of the rear wall.

In a particularly preferred manner, the guide units are in each case provided with a guide linkage consisting of several guide arms which can be moved in the manner of a concertina and thereby guides the goods carrier between the operating position and pulled-out position. As an alternative to the concertina-type guidance, a telescopic guidance is also conceivable in which telescopic arms are provided which telescope into one another in a linear manner.

It is possible that the guide arms are designed in the form of swivel arms which are connected swivelably with one another and are swivelable around swivel axes on the upper side and/or goods-carrier side.

In a particularly preferred manner, the guide linkages in each case have two swivel arms, of which a first swivel arm is mounted so as to swivel around a housing-side first swivel axis and a second swivel arm is mounted so as to swivel around a goods-carrier-side second swivel axis, and wherein the two swivel arms are connected swivelably with one another via a third swivel axis. Consequently, with such a configuration the guide linkages can in each case form a knee joint.

In a particularly preferred manner, the synchronisation device is provided with synchronisation means via which the guide units are synchronously connected with one another. As a result, a movement of one guide unit is also necessarily translated into a movement of the other guide unit, so that the guide units are synchronised during the traversing movement between the operating position and the pulled-out position of the goods carrier.

In a further development of the invention, the guide units are coupled with the goods carrier at a coupling interface by means of coupling means, wherein the synchronisation means are arranged in the region of the coupling interface.

In a particularly preferred manner, the synchronisation means are arranged on the one hand on the goods-carrier-side guide arm, in particular swivel arm, of one guide unit and on the other hand on the goods-carrier-side guide arm, in particular swivel arm, of the other guide unit. Where the guide arms are designed in the form of swivel arms, these synchronisation means are expediently arranged on the goods-carrier-side swivel axes.

In a further development of the invention, the synchronisation means are designed in the form of toothed segments, toothed racks, threaded rods, cable pulls and/or belts.

In a particularly preferred manner, synchronisation means designed in the form of toothed segments are arranged on the goods-carrier-side swivel arm on the guide unit, such that they are in intermeshing engagement with one another.

In a particularly preferred manner, the coupling means for coupling the guide unit to the goods carrier are designed in the form of a bulkhead partition which is mounted so as to be movable by means of the guide units between an operating position located in the region of the rear wall and a pulled-out closure position in the region of a housing opening of the housing.

The invention further comprises a heating device, in particular an oven, with a housing enclosing a heatable interior space, wherein the interior space is limited at the rear by a rear wall and at the front by a door, which in a closed position closes off a housing opening permitting access to the interior space, wherein at least one goods carrier which can be removed from the housing after opening the door is received within the housing for the purpose of heating the goods, which is characterised by a guide device according to the present invention.

BRIEF DESCRIPTION OF THE DRAWINGS

A preferred exemplary embodiment of the invention is illustrated in the drawing and is explained in greater detail in the following, wherein.

DETAILED DESCRIPTION

FIGS. 1 to 7 show preferred exemplary embodiments of the guide device 11 according to the invention used in a heating device 12 in the form of a baking oven. It would also be conceivable to use the guide device 11 in other heating devices 12, for example in a steam cooker or a microwave.

However, the guide device 11 according to the invention is explained in the following with reference to the example of a baking oven.

Figure 1:
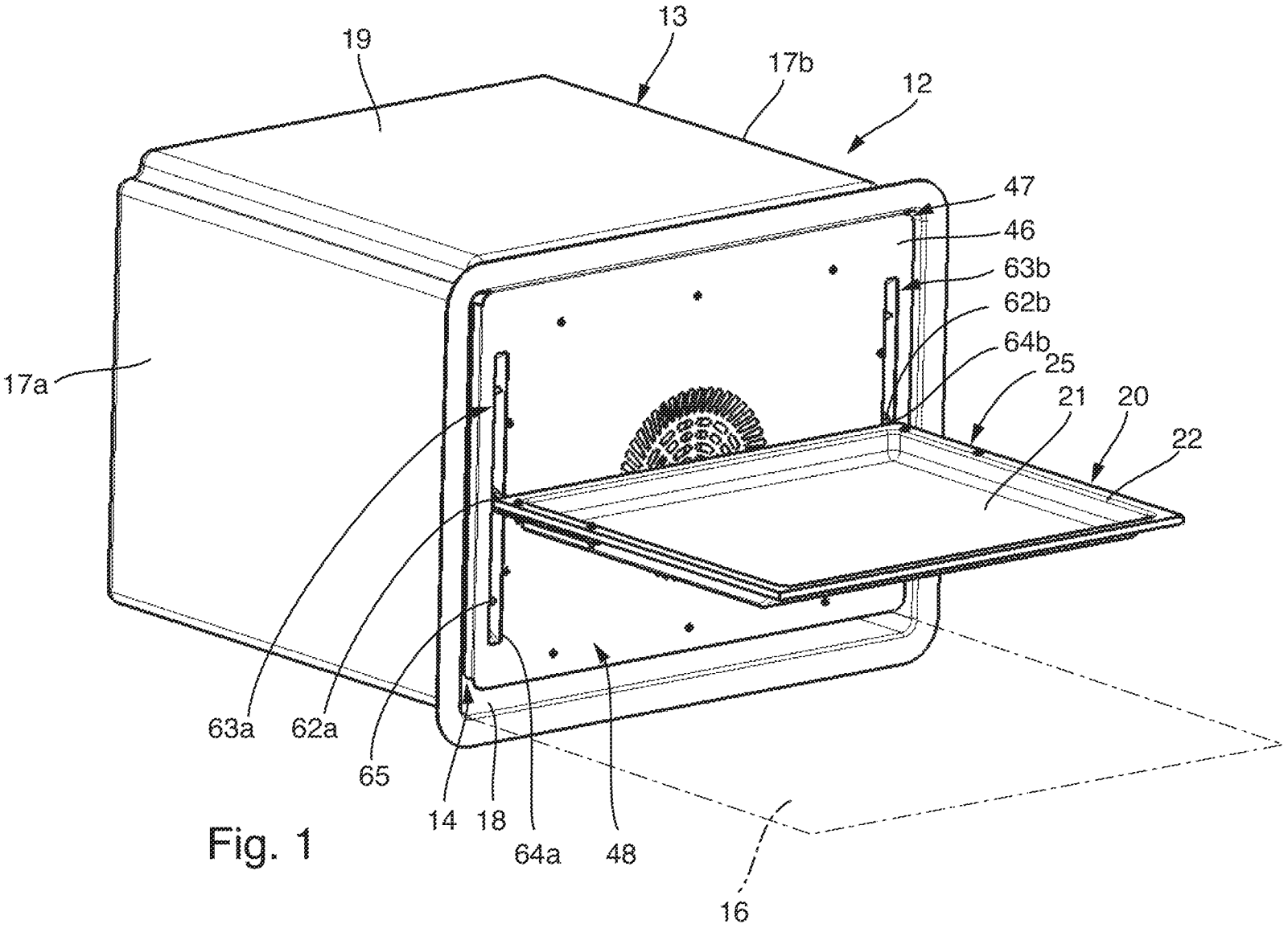
FIG. 1 shows a perspective representation of a heating device with a preferred exemplary embodiment of the guide device according to the invention (not shown)

As shown in particular in FIG. 1, the baking oven has a housing 13 which in the example shown is cuboid in form.

The housing 13 encloses a heatable interior space 14 which is limited at the rear by a rear wall 15 and at the front by a door 16.

In a closed position, the door 16 closes off access to the interior space 14. Expediently, the door is designed in the form of a hinged flap and can be swung forward and down when opening.

The housing also has two opposing side walls 17*a*, 17*b*, a floor 18 and an upper wall 19 opposite this.

At least one goods carrier 20 which can be removed from the housing 13 after opening the door 16 is received within the housing 13 for the purpose of heating goods. In the example of the baking oven, the goods carrier is in the form of a carrier for goods which are to be cooked, for example in the form of a baking tray or oven rack.

In FIG. 1 the goods carrier is shown by way of example in the form of a baking tray which has a tray section 21 and a raised border section 22 bordering the tray section on all sides.

Figure 2:
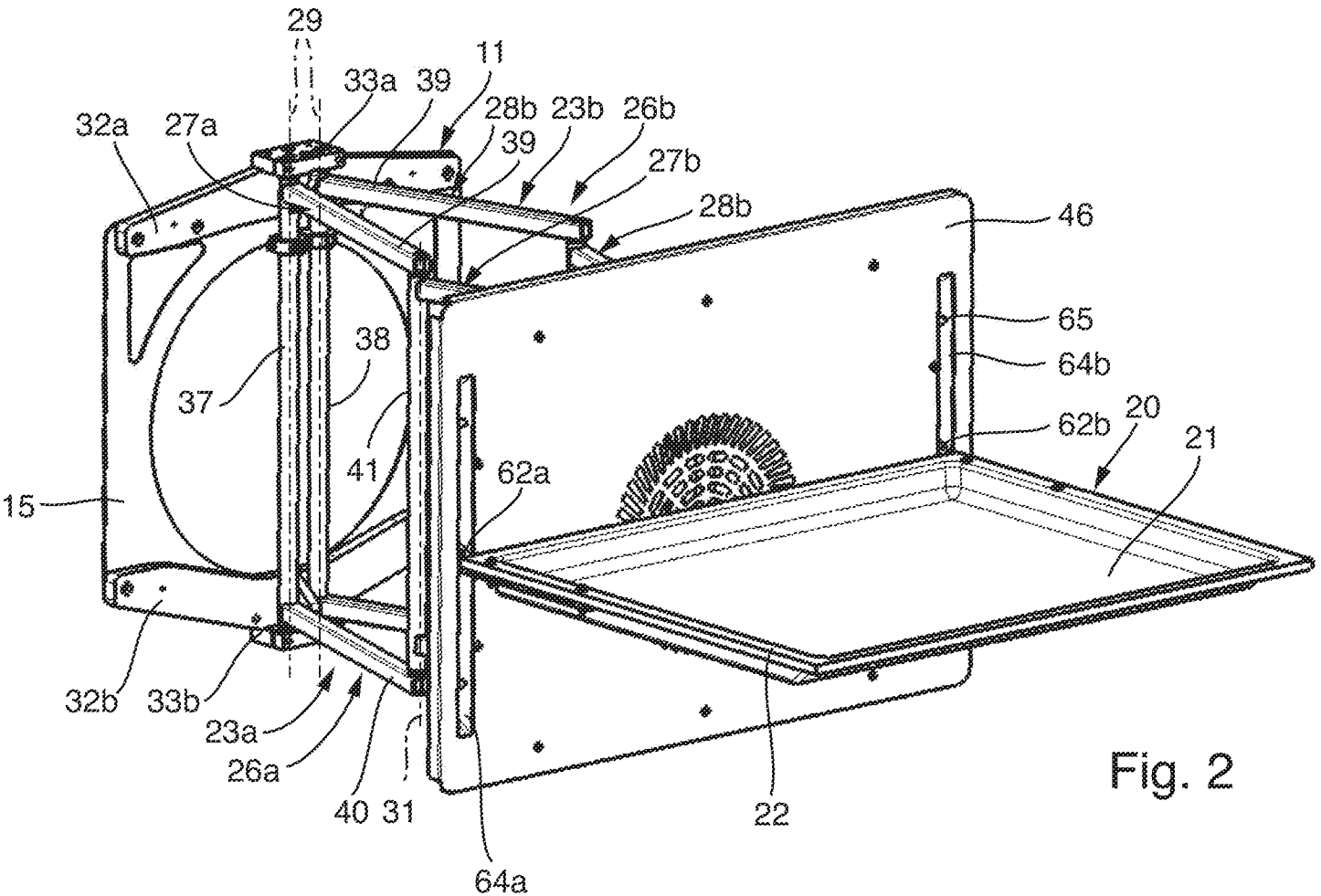
FIG. 2 shows a perspective representation of the heating device from FIG. 1 without the housing, in which the guide device according to the invention is shown.
Figure 3:
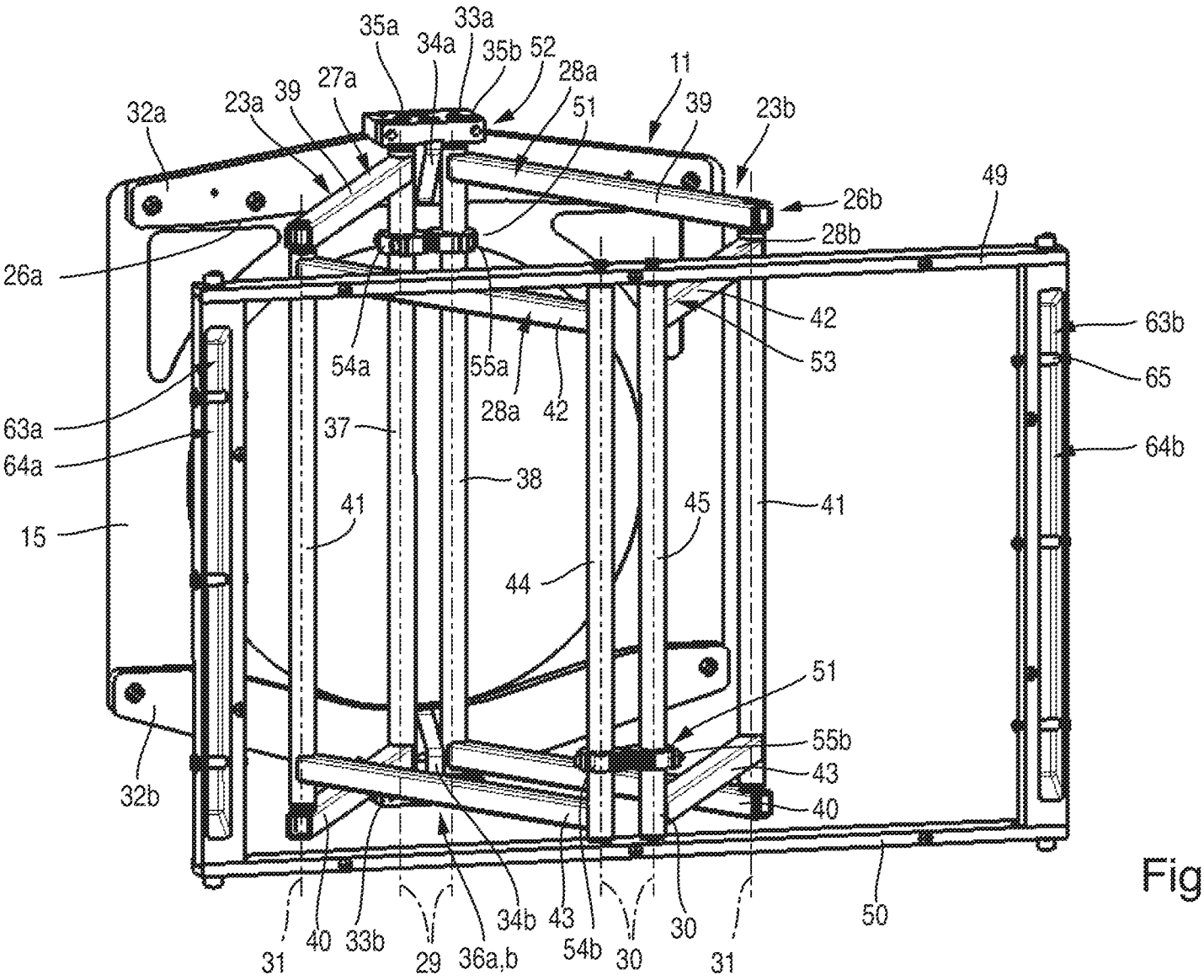
FIG. 3 shows a perspective representation of the preferred exemplary embodiment of the guide device according to the invention.

As shown in particular in FIG. 2 and even more clearly in FIG. 3, the guide device 11 has two guide units 23*a*, 23*b* which are each, at a transverse distance from one another, on the one hand fixed to the housing 13 and on the other hand coupled to the goods carrier 20, and which guide the goods carrier through a traversing movement between a slid-in operating position 24 (FIG. 4) and a pulled-out position 25 in which it is at least partially drawn out of the housing 13.

Figure 4:
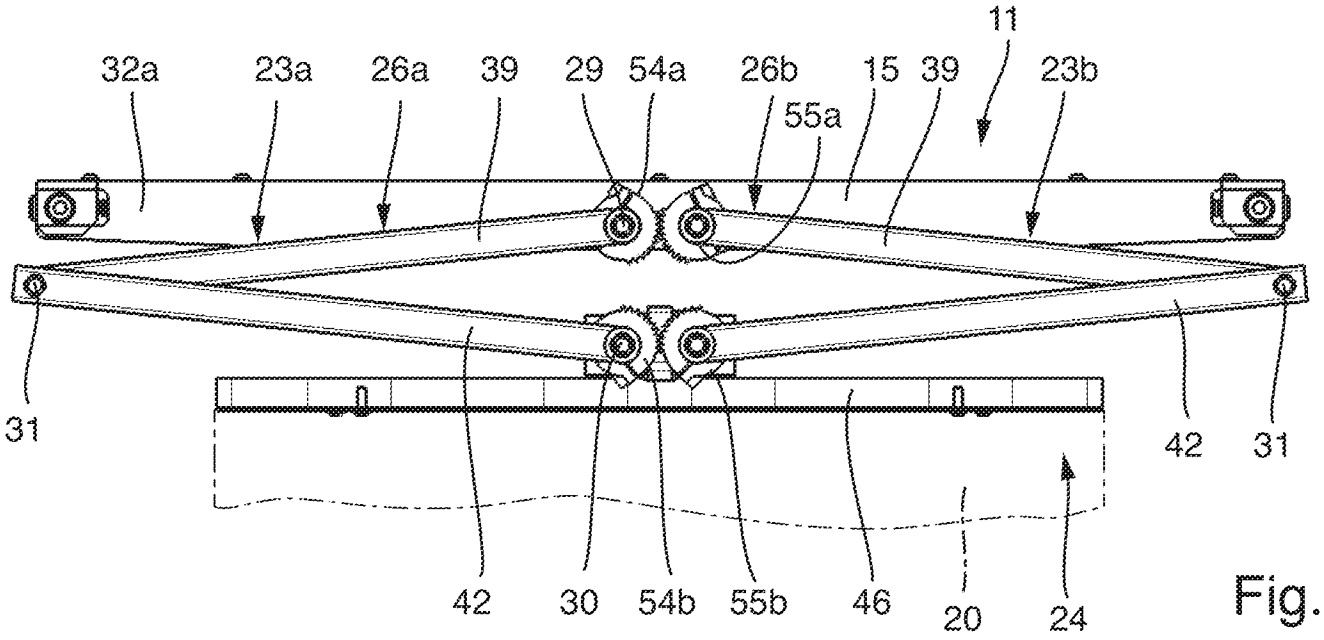
FIG. 4 shows a top view of the guide device from FIG. 1, wherein the goods carrier is in the operating position.
Figure 5:
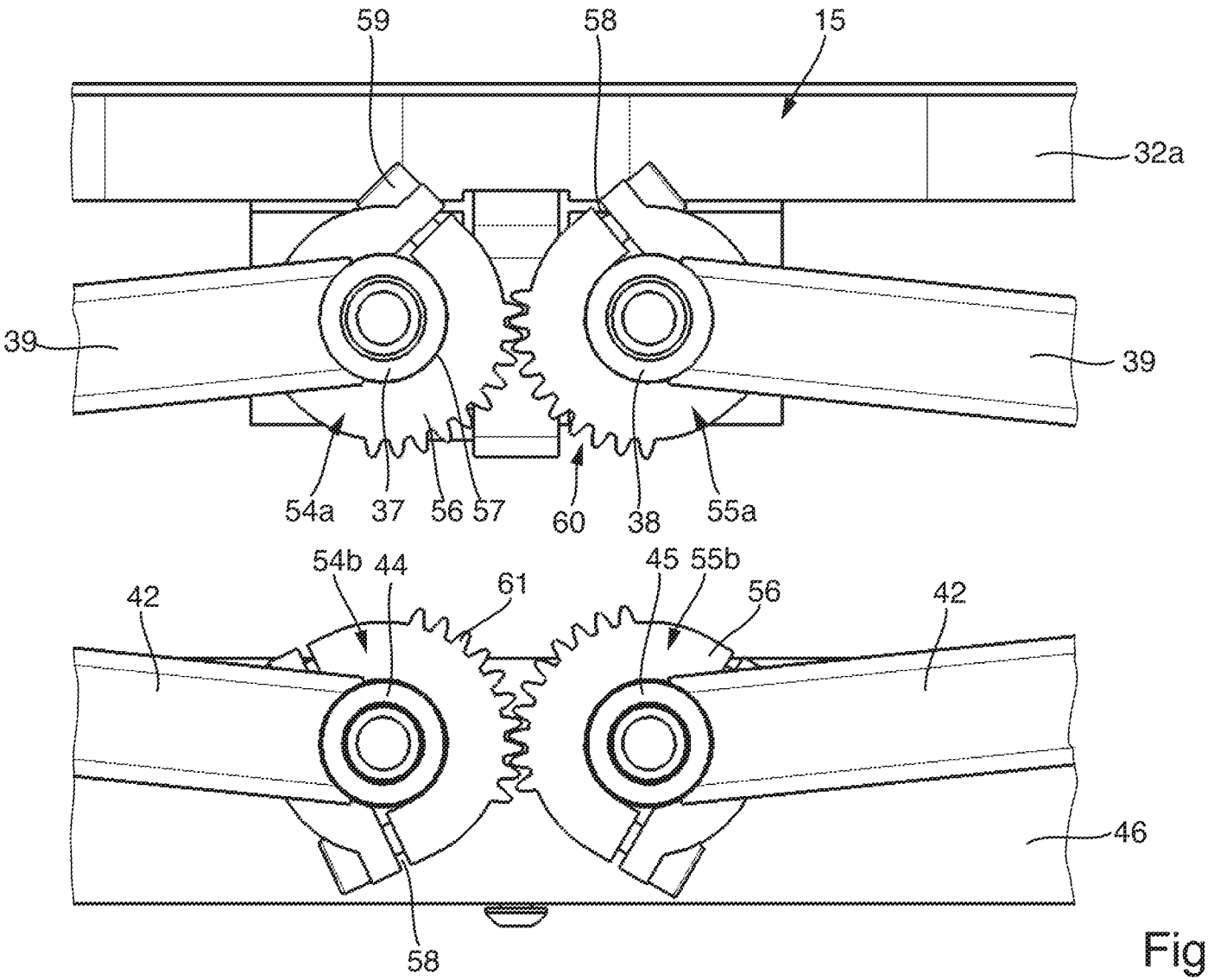
FIG. 5 shows an enlarged representation of the detail X from FIG. 4, in which the synchronisation device is shown more clearly.
Figure 6:
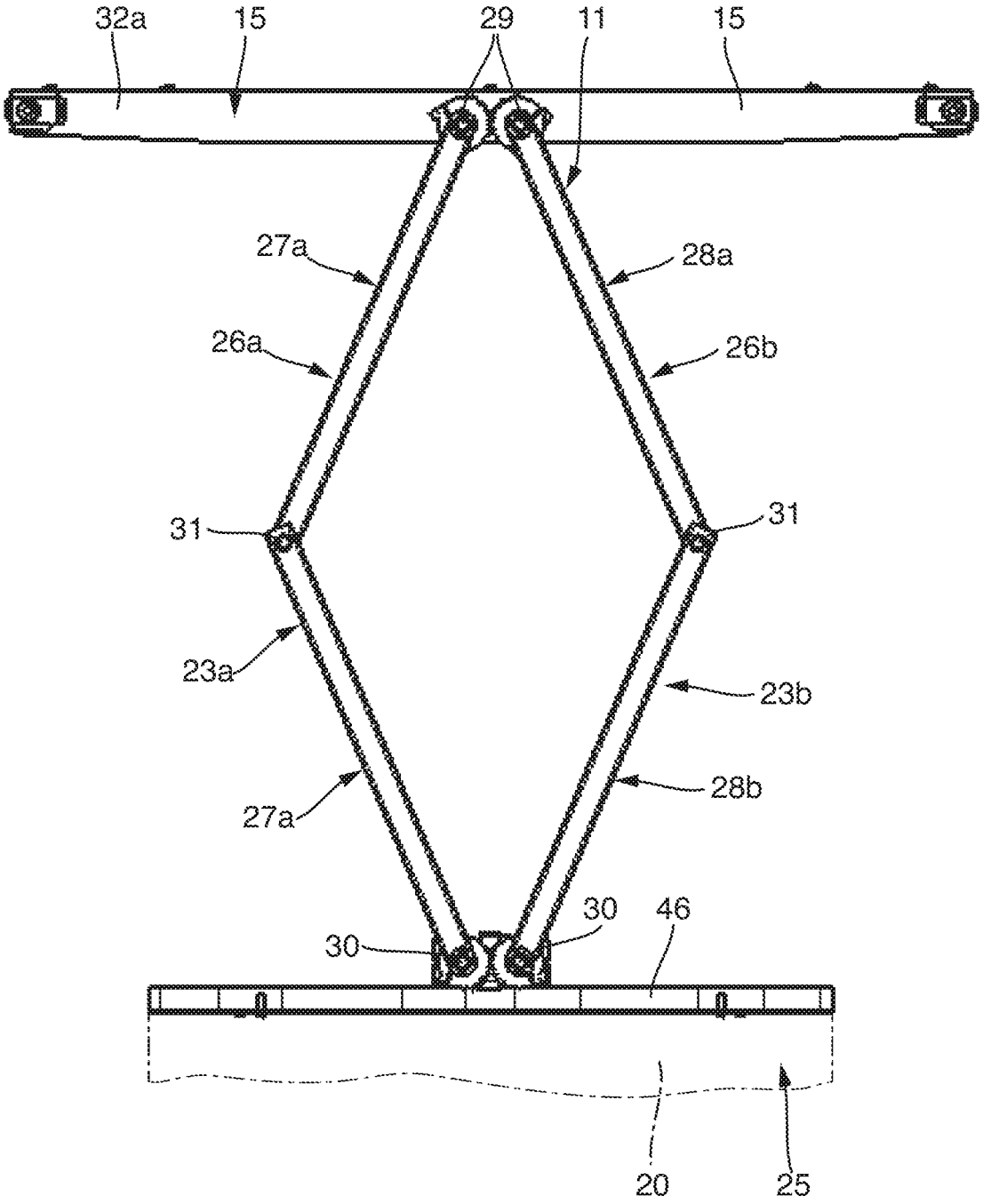
FIG. 6 shows a top view of the guide device from FIG. 3, wherein the goods carrier is in the pulled-out withdrawal position
Figure 7:
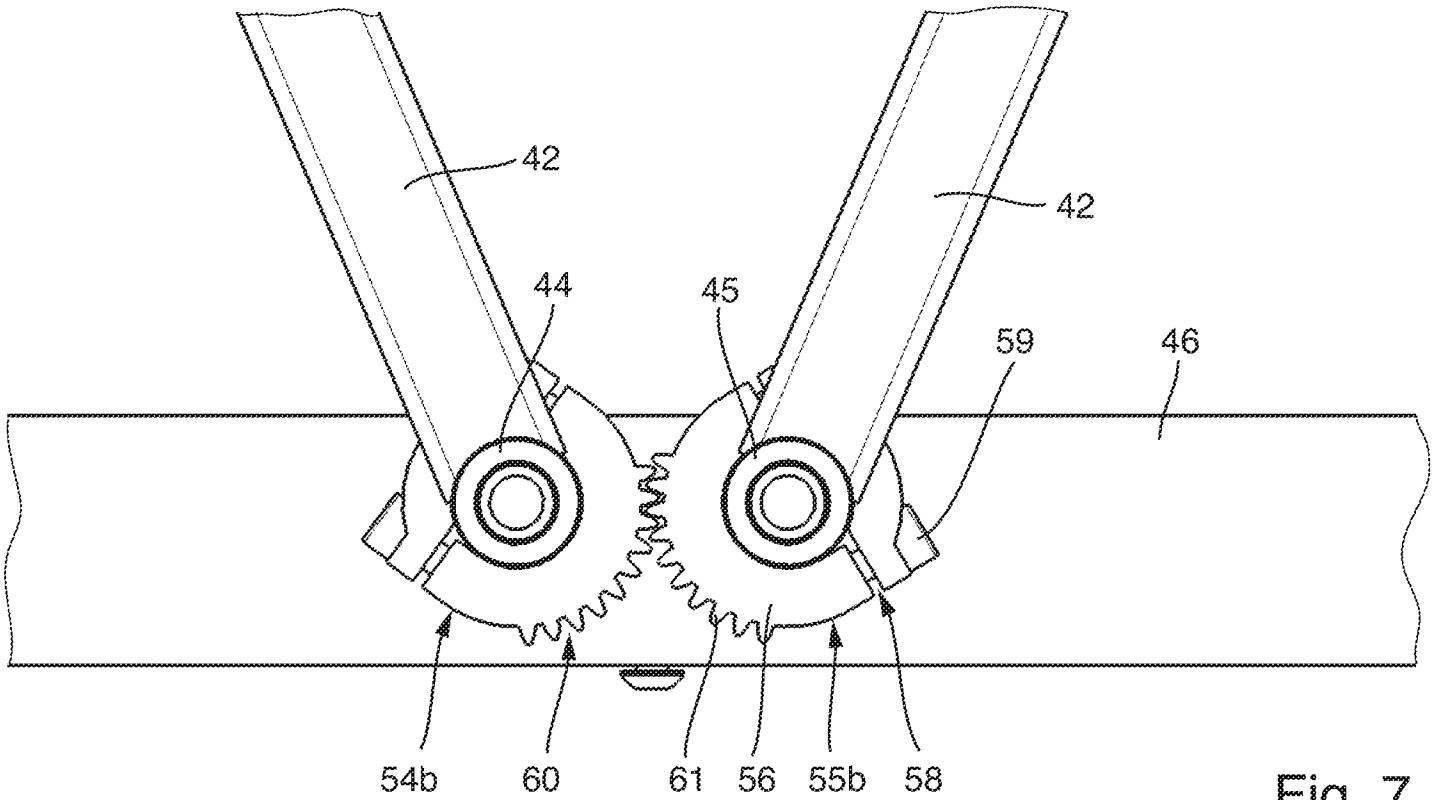
FIG. 7 shows an enlarged representation of the detail Y from FIG. 6, wherein the synchronisation device is shown more clearly.

As shown in particular by the combination of FIGS. 4 and 6, the guide units 23*a*, 23*b* are in each case provided with a guide linkage 26*a*, 26*b* consisting of several guide arms which can be moved in the manner of a concertina and thereby guide the goods carrier 20 between the operating position and pulled-out position 25.

In the example shown, two guide units 23*a*, 23*b* are provided which in each case consist of guide arms and in each case have a guide linkage 26*a*, 26*b*, wherein the guide linkages jointly form a type of concertina guide.

As shown in particular in FIG. 3, the guide linkages 26*a*, 26*b* in each case have two swivel arms 27*a*, 27*b*; 28*a*, 28*b*, of which a first swivel arm 27*a*, 28*a* is mounted so as to swivel around a housing-side first swivel axis 29 and a second swivel arm 27*b*, 28*b* is mounted so as to swivel around a goods-carrier-side swivel axis 30. The two swivel arms 27*a*, 27*b*; 28*a*, 28*b* of a guide linkage 26*a*, 26*b* are connected swivelably with one another via a third swivel axis 31, which can also be described as a connecting joint.

As shown in particular in FIG. 3, the two guide linkages 26*a*, 26*b* are fastened to the rear wall 15 of the housing 13 of the baking oven by means of fastening means. The fastening means include an upper yoke 32*a* and a lower yoke 32*b*, which are in each case fastened to the rear wall 15 of the housing 13, the upper yoke 32*a* in the region of the upper wall 19 and the lower yoke 32*b* in the region of the floor 18 of the housing, but in each case to the rear wall 15. The two yokes 32*a*, 32*b* substantially extend over the entire width of the rear wall 15.

As shown in particular in FIGS. 2 and 3, an upper swivel arm support 33*a* is attached to the upper yoke 32*a* and a lower swivel arm support 33*b* is attached to the lower yoke 32*b*, at the front end of the associated yokes 32*a*, 32*b* pointing in the direction of the interior space 14. In order to fasten the swivel arm supports 33*a*, 33*b* in each case noses 34*a*, 34*b* are provided which project forwards in the direction of the interior space 14 from the front side of the respective yoke 32*a*, 32*b*. The upper swivel axis support 33*a* rests on the upper nose 34*a*, while the lower swivel arm support 33*b* is covered by the lower nose 34*b*.

As shown in particular in FIG. 3, the swivel arm supports 33*a*, 33*b* each possess two bearing openings 35*a*, 35*b*; 36*a*, 36*b* arranged at a transverse distance from one another, of which first bearing openings 35*a*, 36*a* in the upper and lower swivel arm supports 33*a*, 33*b* are aligned with one another and form a mounting for a vertical strut 37 of the first swivel arm 27*a* of the first guide linkage 26*a*. The housing-side first swivel axis 29 runs through the vertical strut 37. Second bearing openings 35*b*, 36*b* are located on the two swivel arm supports 33*a*, 33*b* at a distance from the first bearing openings 35*a*, 36*a* which are also aligned with one another and form mountings for a further vertical strut 38 of the first swivel arm 28*a* of the second guide linkage 26*b*. The housing-side first swivel axis 29 of the first swivel arm of the second guide linkage 26*b* runs through the vertical strut 38. As shown in particular in FIG. 3, the two first swivel arms 27*a*, 28*a* of the two guide linkages 26*a*, 26*b* are formed from vertical and horizontal struts. The aforementioned vertical struts 37, 38 are arranged rotatably in the associated bearing openings 35*a*, 35*b* or 36*a*, 36*b*. The two first swivel arms 27*a*, 28*a* each possess an upper horizontal strut 39 which in each case projects forward obliquely from the vertical struts 37, 38 and are connected rigidly with the associated vertical struts 37, 38. The first swivel arms 27*a*, 28*a* also possess a lower horizontal strut 40 which is arranged parallel to the upper horizontal strut 39 and is also formed rigidly with the associated vertical struts 37, 38. The upper horizontal struts 39 and the lower horizontal struts 40 of the two swivel arms 27*a*, 28*a* are connected with one another at their free ends through a connecting strut 41, which is also in the form of a vertical strut. The connecting strut 41 is thereby on the one hand mounted swivelably on the upper horizontal strut and on the other hand mounted swivelably on the lower horizontal strut 40, as a result of which the third swivel axis 31 is formed. In turn, an upper and a lower horizontal strut 42, 43 extend from the respective connecting struts 41 which are associated with the respective second swivel arms 27*b*, 28*b* of the guide linkages 26*a*, 26*b*. The upper and lower horizontal struts 42, 43 are arranged rigidly on the connecting struts 41 and, in contrast to the other upper and lower horizontal struts 39, 40, extend from the outside inwards so that, overall, the horizontal struts 39, 40, 42, 43 assume the form of a rhombus. The upper and lower horizontal struts 42, 43 of the respective second swivel arms 27*b*, 28*b* are on the other hand connected rigidly with vertical struts 44, 45 which are in turn mounted swivelably on a bulkhead partition 46.

As shown in particular in FIG. 1, the bulkhead partition 46 is arranged in the interior space 14 and is guided moveably by means of the guide device 11 between an operating position located in the region of the rear wall 15 and a closure position 48 in which it is pulled out into the region of a housing opening 47, closing off the housing opening 47 substantially completely.

As shown in particular in FIG. 3, the bulkhead partition 46 comprises a frame 49 which has an upper and a lower horizontally-oriented frame part 49, 50. The two vertical struts 44, 45 are mounted rotatably on the one hand on the upper and on the other hand on the lower frame part 49, 50.

The guide device 11 further comprises a synchronization device 51 for synchronizing the movement of the guide units 23*a*, 23*b* during the traversing movement of the goods carrier 20 coupled to the guide units 23*a*, 23*b*.

As shown in particular in FIG. 3, the two vertical struts 37, 38 form a first coupling interface 52 in the region of the rear wall 15 of the housing 13, while the two vertical struts 44, 45 form a second coupling interface 53 in the region of the bulkhead partition 46 via which the guide units 23*a*, 23*b* are coupled on the one hand to the rear wall of the baking oven and on the other hand to the goods carrier 20. As shown in particular by a combination of FIGS. 3, 4, 5 and 6, the synchronization device 51 comprises synchronization means via which the guide units 23*a*, 23*b* are synchronously coupled with one another.

The synchronization means are shown by way of example in the form of toothed segments 54*a*, 54*b*; 55*a*, 55*b*. As shown in particular in FIG. 5, the swivel arms 27*a*, 28*a* of the guide linkages 26*a*, 26*b* are assigned first toothed segments 54*a*, 55*a* which are in each case arranged in the region of the housing-side first coupling interface 52.

The first toothed segments 54*a*, 55*a* in each case possess a cylindrical base section 56 with a central through-opening 57, wherein the cylindrical base section 56 has a radial slot 58 running in a radial direction which makes it possible for the associated vertical struts 37, 38 to be installed from the side. The radial slot 58 thus makes possible a lateral introduction of the toothed segments 54*a*, 55*a* onto the vertical strut 37, 38. As shown in particular in FIG. 5, the two arms of the cylindrical base section which are separated by the radial slot 58 are connected with one another by means of a fastening screw 59, that is to say by tightening the fastening screw the radial slot 58 can be narrowed, as a result of which the previously introduced toothed segment 54*a*, 55*a* is fixed at the desired height along the vertical strut 37, 38. As shown in particular in FIG. 5, the cylindrical base section 56 possesses on its lateral surface a toothed section 60 with a row of teeth consisting of teeth 61 arranged behind one another in a circumferential direction. As shown in particular in FIG. 5, the toothed sections 60, i.e. the teeth of the first toothed segment 54*a* on the first swivel axis 27*a* of the first guide linkage 26*a*, thus intermesh with the toothed section or the teeth 61 on the first toothed segment 55*a* of the first swivel arm 28*a* of the second guide linkage 26*b*.

As also shown in FIG. 3, two intermeshing toothed segments 54*b*, 55*b* are also provided on the second coupling interface 53 which are identical in design to the toothed segments 54*a*, 55*a* described above. In contrast to the toothed segments 54*a*, 55*a* described above, the further toothed segments 54*b*, 55*b* are located in the region of the lower horizontal sections 43. Here too, the toothed sections with the teeth 61 of one toothed segment 54*b* on the second swivel arm 27*b* of the first guide linkage 26*a* intermesh with the toothed sections or the teeth 61 of the second swivel arms 28*b* of the second guide linkage 26*b*.

As shown in particular in FIG. 1, the bulkhead partition 46 is coupled by means of coupling means with the at least one goods carrier 20, which by way of example is shown in the form of a baking tray, such that the bulkhead partition 46 can be moved by pulling out the goods carrier 20 from the operating position into the closure position 48.

The coupling means comprise at least one hook element 62 and at least one hook mounting 63 for the detachable mounting of the at least one hook element. In the example shown, two hook elements 62 projecting backwards from the rear edge of the baking tray are located on the rear wall of the baking tray, while the associated hook mountings are located on the two outer edge regions of the bulkhead partition 46. The hook mountings 63 in each case comprise a mounting slot 64 running in the vertical direction of the bulkhead partition, and with hooking members 65 lying above one another in a vertical direction at a vertical distance which pass through the slot width of the associated mounting slot. The hook elements 62 or engaging hooks on the rear side of the baking tray can then be hooked into the associated hooking members 65 at the desired height on the bulkhead partition.

FIG. 4 shows the bulkhead partition 46 and the goods carrier 20 in the form of the baking tray coupled thereto in a rear operating position 24 in which the bulkhead partition 46 is arranged close to the rear wall 15 of the housing 13. The two guide linkages 26*a*, 26*b* are thereby folded together to the maximum extent, wherein the two swivel axes 31 on the first guide linkage 26*a* and on the second guide linkage 26*b* lie outside the outer ends of the yokes 32*a*, 32*b*. The connecting struts 37, 38 on the housing-side first coupling interface 52 and the vertical struts 44, 45 on the second goods-carrier-side coupling interface 53 are oriented towards one another at a minimal distance.

Following completion of a process of cooking the foodstuffs on the baking tray, the door 16 is opened and the baking tray is pulled out into its pulled-out position 25. The bulkhead partition 46 thereby moves forwards and closes off the housing opening 47 substantially completely. The two guide linkages 26*a*, 26*b* are unfolded so that the two coupling interfaces 52, 53 assume the maximum distance from one another. The two third swivel axes 31 are shifted in the direction of the centre. Through the toothed segments 54*a*, 54*b*; 55*a*, 55*b*, both on the first coupling interface 52 and also on the second coupling interface 53, the movement of one guide linkage 26*a* is translated synchronously into a movement of the other guide linkage 26*b*, that is to say, if for example the baking tray is pulled out by grasping it by a left- or right-hand corner of the baking tray, the synchronization of the two guide linkages 26*a*, 26*b* by means of the toothed segments 54*a*, 54*b*; 55*a*, 55*b* prevents the baking tray from being canted or actually coming into contact with the side walls of the housing.

In addition to ensuring substantially complete closure of the housing opening 47, the bulkhead partition 46 also has the function of protecting the lifting mechanism of the guide device 11, i.e. the two guide linkages 26*a*, 26*b*, so that these are not damaged or soiled.

What is claimed is:

1. A guide device for guiding a goods carrier within a housing, having at least two guide units, which are each at a transverse distance from one another, on the one hand fixed to the housing and on the other hand coupled to the goods carrier, and which guide the goods carrier through a traversing movement between a slid-in operating position and a pulled-out position in which it is at least partially drawn out of the housing, wherein a synchronization device is provided in order to synchronize the movement of the guide units during the traversing movement of the goods carrier coupled to the guide units, wherein the synchronization device is provided with synchronization means via which the guide units are synchronously coupled with one another, and wherein the guide units are coupled with the goods carrier at a coupling interface by means of coupling means, and the synchronization means are arranged in the region of the coupling interface, and wherein the coupling means for coupling the guide units to the goods carrier are in the form of a bulkhead partition, which is mounted so as to be movable by means of the guide units between an operating position located in the region of the rear wall and a pulled-out closure position in the region of a housing opening.

2. A heating device with a housing enclosing a heatable interior space, wherein the interior space is limited at the rear by a rear wall and at the front by a door, which, in a closed position, closes off a housing opening permitting access to the interior space, wherein at least one goods carrier for goods which are to be heated which can be removed from the housing after opening the door is received within the housing, wherein the heating device comprises a guide device according to claim 1.

3. The guide device according to claim 1, wherein the guide units are fastened to a rear wall of the housing by means of a fastening, wherein the fastening is provided in the central region of the rear wall in relation to the lateral direction of the rear wall.

4. The guide device according to claim 1, wherein the guide units are in each case provided with a guide linkage comprising several guide arms which can be moved in the manner of a concertina and thereby guide the goods carrier between the operating position and pulled-out position.

5. The guide device according to claim 4, wherein the guide arms are designed in the form of swivel arms, which are connected swivelably with one another and are swivelable around swivel axes on the body side and/or goods-carrier side.

6. The guide device according to claim 5, wherein the guide linkages in each case have two swivel arms, of which a first swivel arm is mounted so as to swivel around a housing-side first swivel axis and a second swivel arm is mounted so as to swivel around a goods-carrier-side second swivel axis, and wherein the two swivel arms are connected swivelably with one another via a third swivel axis.

7. The guide device according to claim 1, wherein the synchronization means are arranged on the one hand on the goods-carrier-side guide arm of one guide unit and on the other hand on the goods-carrier-side guide arm of the other guide unit, wherein, where the guide arms are designed in the form of swivel arms, the synchronization means are arranged on the goods-carrier-side swivel axes.

8. The guide device according to claim 7, wherein the synchronization means are designed in the form of toothed segments, toothed racks, threaded rods, cable pulls and/or belts.

9. The guide device according to claim 8, wherein synchronization means designed in the form of toothed segments are arranged on the goods-carrier-side swivel arms of the guide units such that they are in intermeshing engagement with one another.

* * * * *